US006538496B1

(12) United States Patent
Tanase

(10) Patent No.: US 6,538,496 B1
(45) Date of Patent: Mar. 25, 2003

(54) LOW VOLTAGE, HIGH IMPEDANCE CURRENT MIRRORS

(75) Inventor: Gabriel E. Tanase, Cupertino, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/675,338

(22) Filed: Sep. 28, 2000

(51) Int. Cl.[7] ..... G05F 1/10; G05F 3/02
(52) U.S. Cl. ..... 327/543; 323/312
(58) Field of Search ..... 327/538, 540, 327/541, 543; 323/312, 315, 316; 330/288

(56) References Cited

U.S. PATENT DOCUMENTS 4,346,344 A * 8/1982 Blaushild ..... 323/313
5,525,897 A * 6/1996 Smith ..... 323/315
6,218,822 B1 * 4/2001 MacQuigg ..... 323/313
6,232,757 B1 * 5/2001 Afghahi et al. ..... 323/314

* cited by examiner

*Primary Examiner*—Terry D. Cunningham
*Assistant Examiner*—Quan Tra
(74) *Attorney, Agent, or Firm*—Blakely, Sokoloff, Taylor & Zafman LLP

(57) ABSTRACT

Low voltage, high impedance current mirrors realizable in MOS or junction transistor circuits and particularly suited for use in integrated circuits. The current mirrors use first and second transistors coupled as a differential pair with a tail current that may be part of the input current to be mirrored. Another component of the input current to be mirrored is applied to the drain/collector of the first transistor of the differential pair, with the gate/base of that transistor being coupled to a bias voltage. The voltage on the drain/collector of the first transistor is effectively inverted and used to control the gate/base of the second transistor to provide a drain/collector current in the second transistor equal to the difference between the tail current and the current in the drain/collector of the first transistor. Various embodiments are disclosed.

5 Claims, 3 Drawing Sheets

LOW VOLTAGE, HIGH IMPEDANCE CURRENT MIRRORS

BACKGROUND OF THE INVENTION

1. Field of the Invention

The present invention related to the field of current mirrors as commonly used in integrated circuits.

2. Prior Art

Current mirrors are very frequently used in integrated circuits to set bias currents for various parts of the circuit. Typically the currents of one or more current sources, such as a current source that is independent of temperature or proportional to absolute temperature, is mirrored to various parts of a circuit so that one (or a very few) current sources may be mirrored to numerous sub-circuits as local current sources for biasing purposes.

Conventional current mirrors are comprised of an input and an output MOS/junction transistor having their sources/emitters connected to one power supply rail and their gates/bases connected together and to the drain/collector of the input transistor. Applying a current to the drain/collector of the diode connected input transistor sets the gate/base voltage of the input transistor and thus the gate/base voltage of the output transistor, biasing the output transistor so that its drain/collector current will be approximately proportional to the current in the drain/collector of the input transistor. However, for a junction transistor current mirror, the collector of the input transistor also carries the base current of both transistors, limiting the accuracy of the current mirror, and the Early effect limits the output impedance of the output transistor. At low voltage operation of both MOS and junction transistor current mirrors, the drain/collector current in the output transistor is even more dependent on the drain/collector voltage, resulting in the output impedance of the current mirror being both low and voltage dependent.

BRIEF SUMMARY OF THE INVENTION

Low voltage, high impedance current mirrors realizable in MOS or junction transistor circuits and particularly suited for use in integrated circuits. The current mirrors use first and second transistors coupled as a differential pair with a tail current that may be part of the input current to be mirrored. Another component of the input current to be mirrored is applied to the drain/collector of the first transistor of the differential pair, with the gate/base of that transistor being coupled to a bias voltage. The voltage on the drain/collector of the first transistor is effectively inverted and used to control the gate/base of the second transistor to provide a drain/collector current in the second transistor equal to the difference between the tail current and the current in the drain/collector of the first transistor. Various embodiments are disclosed, including an embodiment using a simple current mirror to provide the tail current for the differential pair.

DETAILED DESCRIPTION OF THE PREFERRED EMBODIMENT

Figure 1:
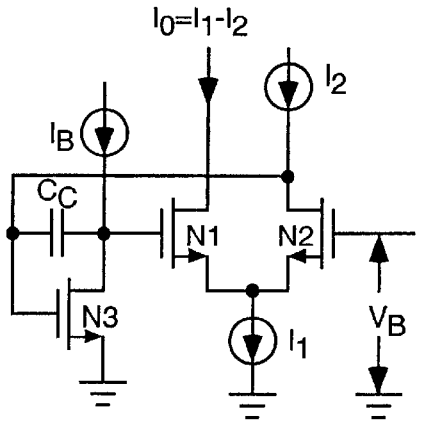
FIG. 1 is a circuit diagram for one embodiment of the present invention realized in an n-channel MOS transistor circuit.

First referring to FIG. 1, a circuit diagram illustrating the principles of an embodiment of the present invention may be seen. This embodiment is comprised of n-channel transistors N1, N2 and N3 and compensation capacitor $C_c$. The circuit provides a high impedance output current $I_0=I_1-I_2$, where either or both of the currents $I_1$ and $I_2$ may be predetermined currents such as bias currents, or may be varying currents, such as may be found in the signal path of various linear integrated circuits. As shall subsequently be seen, the currents $I_1$ and $I_2$ may both be related to an input current, in which case the output current $I_0$ is also proportional to that input current.

N-channel transistors N1 and N2 have their sources connected together and through a current source $I_1$ to ground, effectively forming a transconductance differential amplifier. The gate of transistor N2 is coupled to a bias voltage $V_B$, with one of the input currents $I_2$ being coupled to the drain of transistor N2. Also connected to the drain of transistor N2 is the gate of transistor N3, with capacitor $C_c$ coupled between the gate and drain of transistor N3 providing stability for the circuit. The source of transistor N3 is coupled to ground, with the drain of transistor N3 also being coupled to the gate of transistor N1 and to a current source $I_B$. The output current $I_1=I_1-I_2$ is provided by the drain of transistor N1. Note that the phrase "current source", as used herein and in the claims which follow, is used in a generic sense, as is common in the industry, to refer to both devices or circuits which will provide or source current to another device or circuit, and devices or circuits which will withdraw or sink current from another device or circuit. In operation, the drain of transistor N2 will seek a voltage level that, as applied to the gate of transistor N3, will cause transistor N3 to pass the current $I_B$ to ground, with a drain voltage on transistor N3 just adequate to cause transistor N1 to conduct the output current $I_0=I_1-I_2$.

The high output impedance of the current mirror of FIG. 1 may be illustrated by considering the effect of a change in the drain voltage of transistor N1. In a conventional current mirror, the output current would decrease due to a decrease in the drain voltage of the transistor to which the current was mirrored, because of the drain-source voltage sensitivity in the transistor to which the current is mirrored. However, in the circuit of FIG. 1, when the drain voltage of transistor N1 is decreased, tending to decrease the output current $I_0$, the current through transistor N2 tends to increase to maintain the tail current constant at $I_1$. This causes the drain voltage of transistor N2 to decrease, reducing the gate voltage and thus the current flow through transistor N3 below the bias current $I_B$. Consequently, the gate voltage of transistor N1 will increase to essentially restore the output current $I_0$ to the value $I_1-I_2$. Effectively, transistor N3 inverts the voltage change on the drain of transistor N2 for control of the gate of transistor N1.

When the circuit settles with the reduced drain voltage on transistor N1, the current through transistor N2 will again equal $I_2$. Consequently, the gate-source voltage on transistor N2 will be the same as it was for the higher drain voltage on transistor N1, and thus the voltage across the current source $I_1$ is substantially independent of the drain voltage on transistor N1. Consequently, the impedance of the current source $I_1$ has very little effect on the attainment of the high output impedance for the output current $I_0$.

Figure 2:
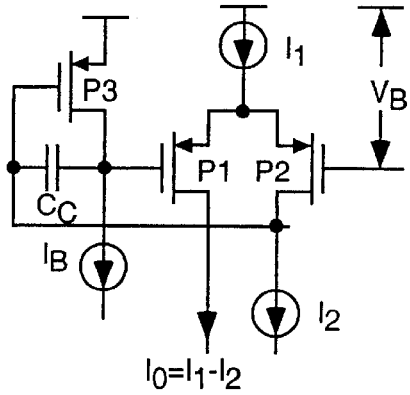
FIG. 2 is a circuit diagram for one embodiment of the present invention realized in an p-channel MOS transistor circuit.

The current mirror of FIG. 1 may be realized in a p-channel MOS structure by flipping the circuit of FIG. 1 upside-down, changing the n-channel devices of FIG. 1 to p-channel devices and reversing the direction of the currents, as illustrated in FIG. 2. In either case, of course, the analysis of the circuit of FIG. 2 is the same as that of FIG. 1, the circuit of FIG. 1 actually sinking current and the circuit of FIG. 2 sourcing current.

Figure 3:
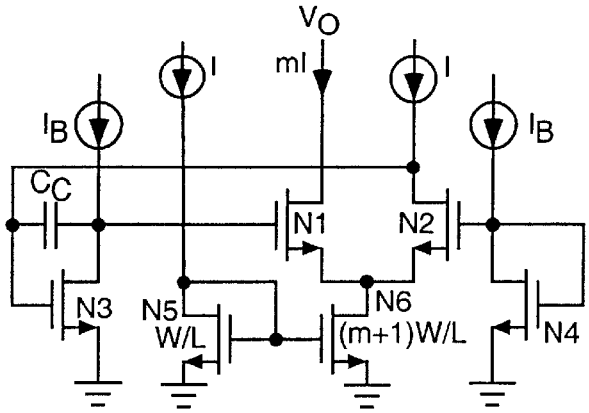
FIG. 3 is a more specific circuit diagram for an embodiment of the present invention realized in an n-channel MOS transistor circuit in accordance with the circuit of FIG. 1.

Now referring to FIG. 3, a particular implementation of the circuit of FIG. 1 may be seen. In this Figure, the bias voltage $V_B$ of FIG. 1 is realized by providing the bias current $I_B$ through a diode-connected n-channel transistor N4. Obviously, however, the bias voltage $V_B$ may be realized by any of various other well-known bias voltage generating circuits. Also, while the bias current $I_B$ provided to the diode-connected transistor N4 is shown in FIG. 3 as being equal to the bias current $I_B$ provided to transistor N3, these currents may be unequal if desired, as the functions of the currents are somewhat different.

Also in FIG. 3, the current source $I_1$ of FIG. 1 is realized by a current mirror comprised of n-channel transistors N5 and N6. In the particular embodiment illustrated in FIG. 3, a current I equal to the current I provided to transistor N2 is also provided to diode-connected transistor N5 to mirror the same to transistor N6, in the embodiment illustrated being m+1 times larger than transistor N5. Thus the output current is equal to $m*I_2$, where m may be equal to one, greater than one, or perhaps even in some applications, less than one. In this circuit, the use of a current through transistor N5 of the current mirror equal to the current to transistor N2 is convenient, though not a necessary requirement, provided the current mirrored to transistor N6 exceeds the current provided to transistor N2 as required for proper functioning of the circuit.

Figure 4:
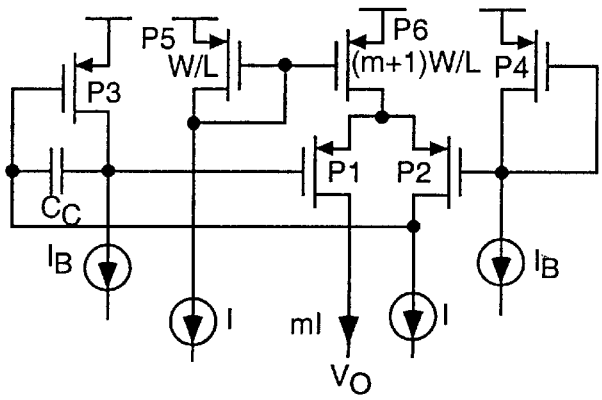
FIG. 4 is a more specific circuit diagram for an embodiment of the present invention realized in an p-channel MOS transistor circuit in accordance with the circuit of FIG. 4.

As before, the current mirror of FIG. 3 may be realized in a p-channel MOS structure by flipping the circuit of FIG. 3 upside-down, changing the n-channel devices of FIG. 3 to p-channel devices and reversing the direction of the currents, as illustrated in FIG. 4. In either case, of course, the analysis of the circuit of FIG. 4 is the same as that of FIG. 3, the circuit of FIG. 3 actually sinking current and the circuit of FIG. 2 sourcing current.

Figure 5:
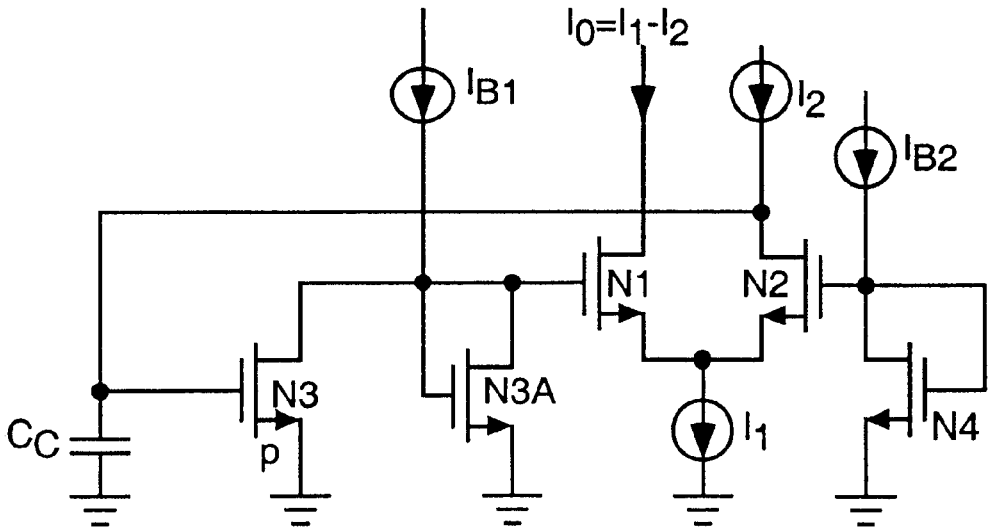
FIG. 5 is an n-channel MOS transistor circuit diagram of an embodiment of the invention having improved stability in comparison to the embodiment of FIG. 3.
Figure 6:
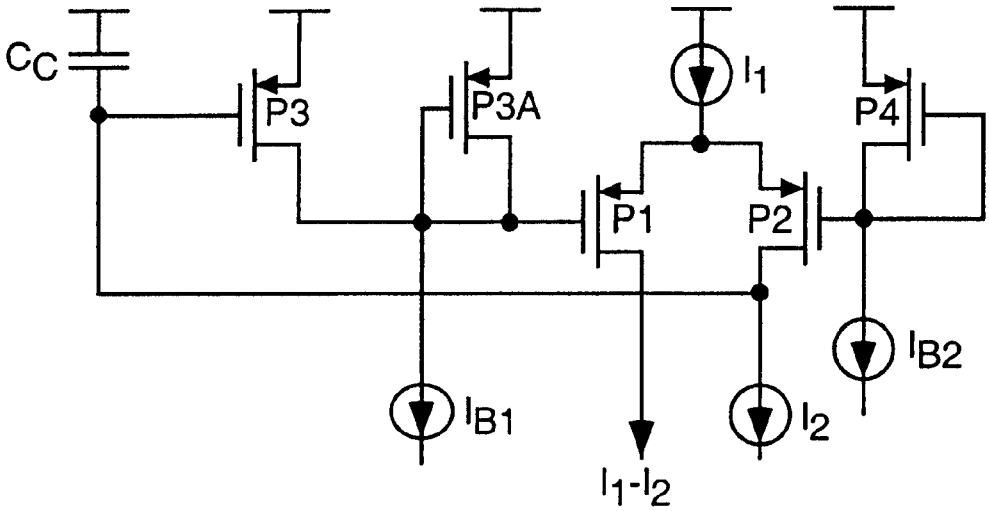
FIG. 6 is a p-channel MOS transistor circuit diagram of an embodiment similar to that of FIG. 5.

Now referring to FIG. 5, a still further alternate embodiment may be seen. In this embodiment, diode connected transistor N3A and transistor N3 are biased by a bias current $I_{B1}$, with the drain of transistor N2 being coupled to the gate of transistor N3. The circuit functions in a manner similar to the circuit of FIG. 1, though the output impedance at the drain of transistor N1 is lower. Also the diode connected transistor N3A will not allow a large voltage swing at the gate of transistor N1, which increases the dropout at the output, the drain of transistor N1. The advantage of this circuit however, is that the circuit stability is improved at the expense of accuracy, so that the value of the compensation capacitor $C_c$ is lower, and may not be needed at all. Of course, the embodiment of FIG. 5 may be flipped vertically (see FIG. 6) as previously described with respect to FIG. 4 in relation to FIG. 3, to obtain an embodiment realized in p-channel devices, or either the embodiment of FIG. 5 or the flipped version may readily be realized by npn or pnp transistors, respectively.

Figure 7:
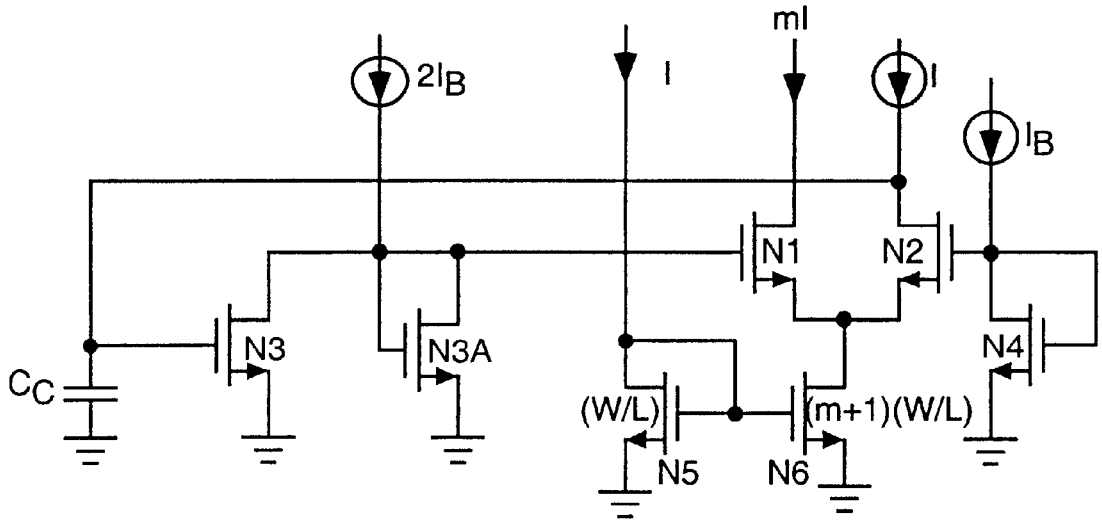
FIG. 7 is a more specific circuit diagram for an embodiment of the present invention realized in an n-channel MOS transistor circuit in accordance with the circuit of FIG. 5.
Figure 8:
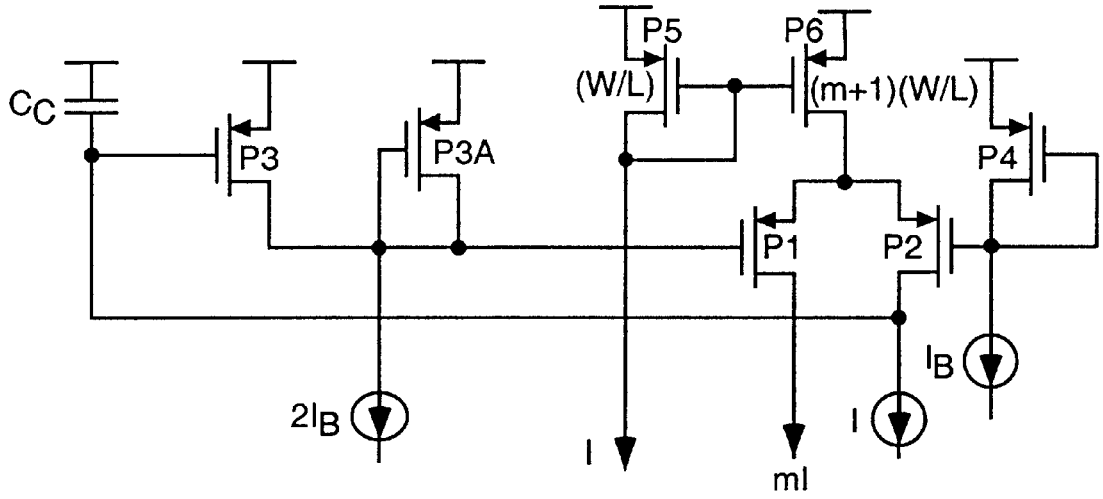
FIG. 8 is a more specific circuit diagram for an embodiment of the present invention realized in an p-channel MOS transistor circuit in accordance with the circuit of FIG. 6.

FIG. 7 is an embodiment similar to that of FIG. 5, though with the current source $I_1$ realized by the current mirror of devices N5 and N6 mirroring the current I to provide the tail current for devices N1 and N2. As shown, devices N5 and N6 may be of different sizes to mirror the current I to provide the tail current (m+1)*I. Similarly, FIG. 8 is an embodiment similar to that of FIG. 6, though with the current source $I_1$ realized by the current mirror of devices P5 and P6 mirroring the current I to provide the tail current for devices P1 and P2. As shown, devices P5 and P6 may be of different sizes to mirror the current I to provide the tail current (m+1)*I. Also the embodiments of FIGS. 7 and 8 may readily be realized by npn or pnp transistors, respectively.

The present invention current mirrors provide an output impedance which is approximately two orders of magnitude higher than the output impedance of prior art two-transistor current mirrors. The minimum voltage dropout (mvd) for current mirrors in accordance with the present invention, determined by transistors N6, P6, respectively, is:

$$V_{0mdv}=\Delta V_{gs}=(V_{gs}-V_t)\approx 200 \text{ mV}$$

Where: $V_{gs}$=gate source voltage $V_2$=threshold voltage.

Thus the current mirrors described herein provide a simple and robust implementation for low voltage precision current sources suitable for use for bias circuits in analog integrated circuit designs where precision and low voltage operation are required, though may be used for purposes other than biasing also. While certain preferred embodiments of the present invention have been disclosed and described herein, it will be understood by those skilled in the art that various changes in form and detail may be made therein without departing from the spirit and scope of the invention.

What is claimed is:

1. A high impedance current mirror comprising:

first, second and third transistors of the same conductivity type, each having first and second terminals and a control terminal, the voltage between the control terminal and the first terminal controlling the current flow between the first and second terminals;

the first terminals of the first and second transistors being coupled together and through a first current source to a power supply terminal, the second terminal of the second transistor being coupled as a current input;

the third transistor having its first terminal coupled to the power supply terminal, its second terminal coupled to a bias current source and to the control terminal of the first transistor, and its control terminal coupled to the second terminal of the second transistor;

the control terminal of the second transistor being coupled to a bias voltage;

a capacitor coupled between the control terminal and the second terminal of the third transistor;

the second terminal of the first transistor being coupled as a current output for the high impedance current mirror, the output current being equal to the current of the first current source minus the input current.

2. A high impedance current mirror comprising:

first, second, third and fourth transistors of the same conductivity type, each having first and second terminals and a control terminal, the voltage between the control terminal and the first terminal controlling the current flow between the first and second terminals;

the first terminals of the first and second transistors being coupled together and through a first current source to a power supply terminal, the second terminal of the second transistor being coupled as a current input;

the third transistor having its first terminal coupled to the power supply terminal, its second terminal coupled to a bias current source and to the control terminal of the first transistor, and its control terminal coupled to the second terminal of the second transistor;

the control terminal of the second transistor being coupled to a bias voltage;

the second terminal of the first transistor being coupled as a current output for the high impedance current mirror, the output current being equal to the current of the first current source minus the input current;

the fourth transistor having its first terminal coupled to the power supply terminal and its second terminal and its control terminal coupled to the second terminal of the third transistor.

3. The high impedance current mirror of claim 2 further comprising a capacitor coupled between the control terminal of the third transistor and the power supply terminal.

4. A method of providing a high impedance current mirror comprising:

providing first and second transistors coupled as a differential pair with a tail current, each of the first and second transistors having first and second terminals and a control terminal, the voltage between the control terminal and the first terminal controlling the current flow between the first and second terminals;

applying an input current to the second terminal of the second transistor of the differential pair, with the control terminal of the second transistor being coupled to a bias voltage;

inverting the voltage change on the second terminal of the second transistor to control the voltage of the control terminal of the first transistor and to provide an output current at the second terminal of the first transistor;

wherein inverting the voltage on the second terminal of the second transistor to control the voltage of the control terminal of the first transistor is done using a diode connected transistor biased by a bias current and controlled by the voltage change on the second terminal of the second transistor.

5. The method of claim 4 further including capacitively coupling the signal on the second terminal of the first transistor to a power supply terminal.

* * * * *